United States Patent [19]

Lucht

[11] Patent Number: 4,563,870

[45] Date of Patent: Jan. 14, 1986

[54] LUBRICATED WIRE ROPE

[75] Inventor: Wilbert A. Lucht, Danville, Calif.

[73] Assignee: United States Steel Corporation, Pittsburgh, Pa.

[21] Appl. No.: 618,797

[22] Filed: Jun. 8, 1984

Related U.S. Application Data

[63] Continuation-in-part of Ser. No. 549,060, Nov. 7, 1983, abandoned.

[51] Int. Cl.[4] ..... D07B 1/16; D07B 7/12

[52] U.S. Cl. ..... 57/223; 57/221; 57/232

[58] Field of Search ..... 57/200, 210, 212, 213–215, 57/217–223, 232, 7; 428/638

[56] References Cited

U.S. PATENT DOCUMENTS

| | | | |
|---|---|---|---|
| 2,372,142 | 3/1945 | Warren | 57/220 |
| 2,509,894 | 5/1950 | Toulmin et al. | 57/221 X |
| 3,104,515 | 9/1963 | Stevens | 57/220 |
| 3,131,530 | 5/1964 | Dietz | 57/220 X |
| 3,718,442 | 2/1973 | Lucht | 428/638 |
| 3,824,777 | 7/1974 | Riggs | 57/217 X |
| 3,922,437 | 11/1975 | Kitta et al. | 57/223 X |
| 4,123,894 | 11/1978 | Hughes et al. | 57/220 X |
| 4,197,695 | 4/1980 | Hughes et al. | 57/221 X |
| 4,344,278 | 8/1982 | Jamison et al. | 57/223 X |

*Primary Examiner*—Donald Watkins

*Attorney, Agent, or Firm*—William L. Krayer

[57] ABSTRACT

A wire rope having extraordinary resistance to wear comprises a core strand and a plurality of outer strands oriented and nested in the same helical lay as the core strand, all the wires thereof being made of a molybdenum-containing steel and having been stress-relieved at a temperature of at least 675° F., said rope being coated inside and outside with a suspension of finely divided molybdenum disulfide in a non-fluid state at room temperature.

4 Claims, No Drawings

LUBRICATED WIRE ROPE

This application is a continuation-in-part of co-pending application U.S. Ser. No. 549,060, filed Nov. 7, 1983, now abandoned, and incorporated herein.

BACKGROUND OF THE INVENTION

Wire rope has long been manufactured to meet very demanding conditions—in its employment in cranes, hoists, drag lines, elevators, ski lifts, various marine environments and mining machinery, it is commonly exposed to the elements and frequently flexed, abraded and tensed under extreme loads. While wire rope intended for such uses has always been made as rugged as economics will permit, its expense is such that a constant search is underway for ways to increase the hours-in-use before it must be replaced.

Various approaches have been employed in the past to reduce wear and increase the life of wire rope.

For example, it is not new to orient the outer strands of the rope in the same lay (i.e. to make a complete 360° helical turn in the same linear measure of rope) with the inner strands so that contact between wires of the inner and outer strands is linear rather than at particular points See U.S. Pat. 3,306,022. The basic idea of internally lubricating wire rope has also been disclosed—see U.S. Pat. Nos. 3,705,489; 2,485,019; 3,824,777 and the prior art recited in U.S. Pat. No. 4,344,278. Stress-relieving has also been practiced at an intermediate stage of wire rope making: U.S. Pat. No. 3,240,570. Likewise it is known (see U.S. Pat. No. 3,718,442) to employ steel of a certain metallurgy, particularly containing a small amount of vanadium and an optional amount of molybdenum in order to improve ductility and other characteristics of the strands. Mixtures of thermoplastic materials and lubricants are disclosed to be useful in the interiors of certain wire ropes—see U.S. Pat. Nos. 4,120,145; 4,123,894 and 2,372,142. For other disclosures generally in the art of making wire rope, see U.S. Pat. Nos. 3,075,344; 3,259,487; 3,293,837; 3,271,944; 3,668,020; 3,374,619 and U.S. Pat. No. Re. 29,537. None of these combines the features of my invention.

SUBJECT OF THE INVENTION

My invention is a wire rope having a core and an outer layer of strands, which is lubricated inside and outside with a normally thick, highly viscous lubricant having a high (at least about 5%) solids content comprising finely divided solid lubricant such as graphite or molybdenum disulfide, the core and outer strands being stress-relieved and in the same lay, and the wire being made of steel including about 0.03 to about 0.3% vanadium, molybdenum, chromium, or mixtures thereof.

While the concept of placing the outer strands on the core strands (which are also helically wound) in the same lay is not new, it is notable that I am for the first time combining the use of an intimately applied solid lubricant with the use of a lay wherein the outer strands are "nested" in the valleys of the core strand. As is known in the art, a core strand will exhibit helical "valleys" tracing the same general pattern as the wires or smaller strands which make up the helical configuration of the core. My invention includes the concept, along with the internal lubricant, of nesting the outer strands in the "valleys" in a manner similar to that of U.S. Pat. No. 3,306,022, to reduce the Hertzian (transverse) stresses and thus increase the strength of the rope. Wire rope wound in this manner, having somewhat less free interior space, tends to have a more stable outer diameter before and during use and thus will not wear as much in the sheaves or suffer unnecessary internal friction.

The lubricant is applied during manufacture of the rope; specifically, it is preferably applied to each wire as the wires are wound into strands and to each strand as the strands are wound into rope. It will be about 3–5% of the weight of the finished rope. Since the lubricant is normally very thick or viscous, i.e. almost solid, it should have a melting point of at least about 130° F. and must be heated to a molten state (typically about 180° F.) in order to apply it to the wires. Any vehicle, such as tar or asphaltic materials, which is solid at ambient temperatures (will not leak out of the wire rope) and which will suspend, without water or solvent, a solid, finely divided lubricant such as graphite or molybdenum disulfide, may be used. The lubricant should be fluid enough under flexing and stress conditions that it will be "self-healing", i.e. it will move back into areas from which it has been forced. Preferably it will also be inhibited against its own oxidative and/or bacteriological deterioration, and will advantageously contain "extreme pressure" additives, rust inhibitors, and additives to improve the lubricant's adhesion to metal, such as are known in the art.

The use of wire of conventional metallurgical composition may lead to disparate perlite spacing—a phenomenon which may be measured in Angstroms as the distance between microscopically observable lines or crystals of perlite. With conventional metallurgy and processing, the variations in perlite or lamellar spacing result in a relatively soft interior of the wire compared to the exterior portions, so that if wear begins at a particular point it will not only continue but actually accelerate with continuing pressure, contact or friction. The vanadium-molybdenum containing composition of U.S. Pat. No. 3,718,442 renders the perlite spacing more uniform throughout the wire and improves hardenability and tensile strength. Thus, the onset of wear at a particular point will not be aggravated because of increasing softness as the wear progresses. Small amounts of chromium may be used instead, and/or any mixture of molybdenum, vanadium, and chromium may be used in amounts from about 0.03% to about 3.0%.

The strands may advantageously be "stress-relieved" —that is, they are heated to a temperature of at least about 675° F. (up to about 900° F.) and passed through a series of flexing devices to secure proper alignment and internal contact, resulting in neutralization of the residual tensile stresses due to winding of the strand, leaving only residual compressive stresses. It has been observed that the yield strength of a strand can be increased 40% by stress relieving, which has a noticeable and favorable effect on wear. If stainless steel is used, the temperature of the stress-relieving process should be about 900°–1150° F. In either carbon or stainless steel, the time employed for cooling is not critical.

Tests and comparisons of my rope with conventional ropes in the field have shown significantly improved life with my rope. The results of some other tests, however, have been obscured because the diameters of the comparison ropes were smaller and in the actual tests the new rope was subject to more sheave abrasion because of its slightly larger diameter.

The following field test results were obtained with my invention on a particular mining machine:

| | Avg. Service - Conventional Ropes | Test Ropes (Invention) |
|---|---|---|
| 1st Drag Line Rope | 756.2 hrs. | 1126.37 hrs. |
| 2nd Drag Line Rope | 756.2 hrs. | 1051.32 hrs. |
| Hoist Line | 2031.2 hrs. | 2475.2 hrs. |

These results are not entirely conclusive, since a fair-lead configuration change was also made on the machine immediately prior to the test. Wear on the ropes was considered normal, however—that is, the wear on the test ropes was not significantly different from wear prior to the change and the contribution of the change the increased life of the test ropes is considered problematical.

I claim:

1. Wire rope comprising a core of a plurality of strands of wire and a plurality of outer strands surrounding said core, each of said outer strands being nested in a space between two of said core strands and oriented in the same helical lay as the core strands, all of said wires and strands being (a) made of a steel including about 0.03% to about 0.3% chromium, vanadium, molybdenum, or mixtures thereof, (b) coated with a lubricant composition comprising a viscous vehicle solid at ambient temperatures and including at least about 5% finely divided solid lubricant, and (c) stress-relieved at a temperature of at least 675° F.

2. Wire rope of claim 1 wherein the lubricant has a melting point of at least 130° F.

3. Wire rope of claim 1 wherein the solid lubricant includes molybdenum disulfide.

4. Wire rope of claim 1 wherein the outer strands are oriented in the same lay as the inner strands.

* * * * *